US006125799A

United States Patent [19]

Van Son et al.

[11] Patent Number: 6,125,799

[45] Date of Patent: Oct. 3, 2000

[54] COMBUSTION ENGINE

[75] Inventors: Cornelis Josephus Andreas Van Son, Laren; Marnix Haitze Hacquebord, Kampen, both of Netherlands

[73] Assignee: Wartsila NSD Nederland B.V., Zwolle, Netherlands

[21] Appl. No.: 09/000,115

[22] PCT Filed: Jul. 16, 1996

[86] PCT No.: PCT/NL96/00289

§ 371 Date: May 27, 1998

§ 102(e) Date: May 27, 1998

[87] PCT Pub. No.: WO97/10420

PCT Pub. Date: Mar. 20, 1997

[30] Foreign Application Priority Data

| | | | |
|---|---|---|---|
| Jul. 21, 1995 | [NL] | Netherlands | 1000859 |
| Sep. 28, 1995 | [NL] | Netherlands | 1001305 |
| Jan. 19, 1996 | [NL] | Netherlands | 1002132 |

[51] Int. Cl.[7] ..... F01P 1/06

[52] U.S. Cl. ..... 123/41.31; 123/196 AB; 123/196 R; 123/195 A

[58] Field of Search ..... 123/DIG. 1, 41.31, 123/196 RA, 196 AB, 198 R, 559.1, 195 A; 60/605.1

[56] References Cited

U.S. PATENT DOCUMENTS

| | | | |
|---|---|---|---|
| 5,065,713 | 11/1991 | Seats | 123/198 R |
| 5,515,817 | 5/1996 | Nurmi et al. | 123/196 AB |

FOREIGN PATENT DOCUMENTS

| | | |
|---|---|---|
| 503438 | 7/1930 | Germany . |
| 4018620 | 12/1991 | Germany . |
| 373222 | 12/1963 | Switzerland . |
| 1326503 | 8/1973 | United Kingdom . |

*Primary Examiner*—Noah P. Kamen

*Attorney, Agent, or Firm*—Webb Ziesenheim Logsdon Orkin & Hanson, P.C.

[57] ABSTRACT

The invention relates to a combustion engine provided with an engine block having a plurality of cylinders received therein and auxiliary equipment connected to the engine, wherein the engine block has identical connecting parts at a number of different locations and the auxiliary devices are each arranged on such a connecting part. The positions of the auxiliary devices can thus be interchanged in simple manner subject to the desired configuration of the engine. The invention further relates to an engine block, a cover embodied as casting, a supercharging unit, a lubricant unit and an exhaust gases conduit system, each intended for use in such a combustion engine. Finally, the invention relates to a method for manufacturing a combustion engine, by manufacturing an engine block having identical connecting parts arranged thereon at a number of different positions, determining the use of the engine and, subject thereto, connecting the required auxiliary equipment to the connecting parts.

26 Claims, 12 Drawing Sheets

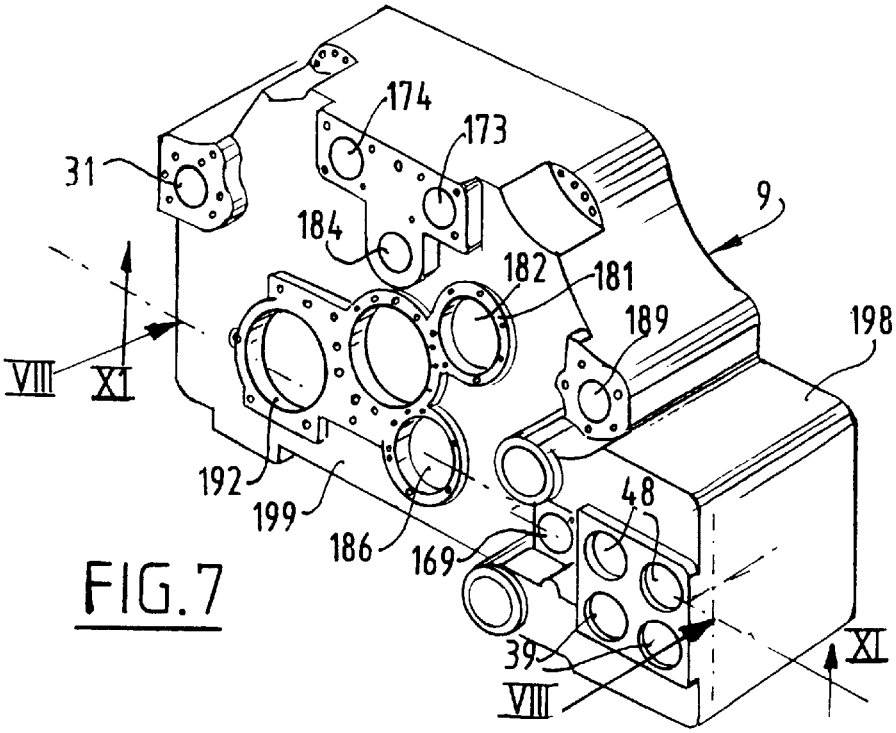
FIG.7
FIG.11
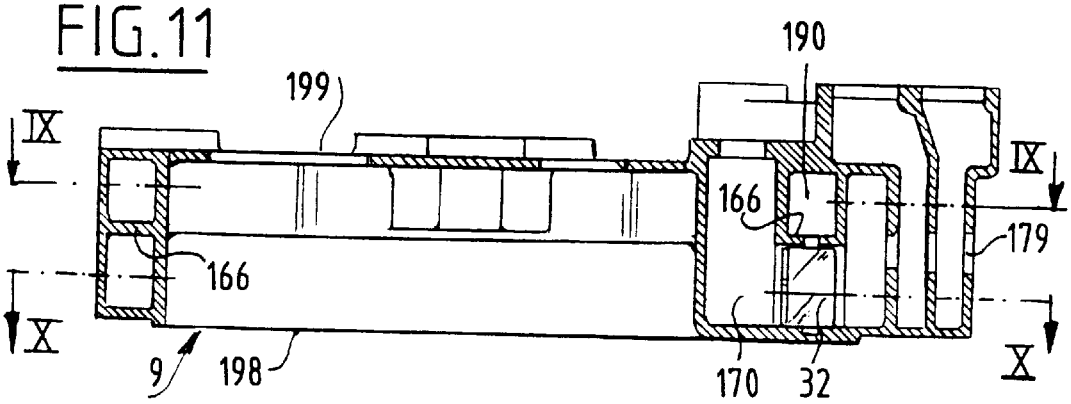
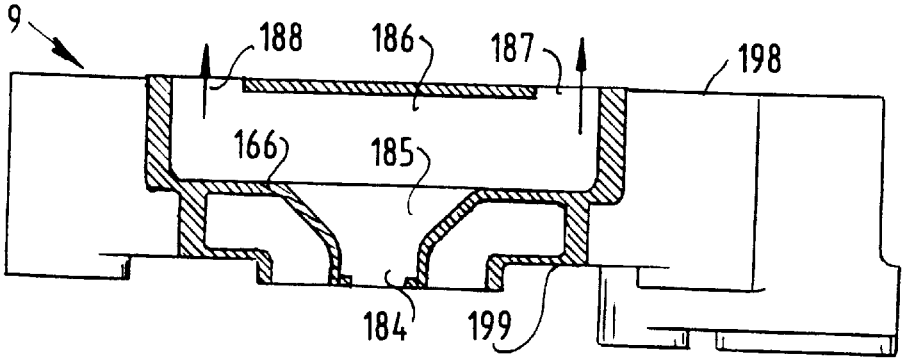
FIG.12

XIX
133
131
58
96
161
15
162
159
163B
163
163A
140
139
163C
104
105
98
120
119
163D
95
99
108
24
138
136
147
157
42
43
144
148
158
143
154
153
151
129
34
94
152
130
146
132

XXI
131
95
135
97
13
104
134
XX
99
153
151
129
155
152
130
154
146
141
150
132
145
143
156
149
147
42
137
157
144
158
148
43
A 141
143
142
155
151
99
137
43
42
144
149
156
136
94
138
108

142
143
131
96
139
137
140
135
97
58
34
94
136

COMBUSTION ENGINE

BACKGROUND OF THE INVENTION

1. Field of the Invention

The invention relates to a combustion engine provided with an engine block having a plurality of cylinders received therein. At least one auxiliary device is connected to the engine, wherein the engine block has at two different locations substantially identical connecting parts and at least one auxiliary device is arranged on such a connecting part. Such a combustion engine is known from DE-A-4018620.

2. Brief Description of the Prior Art

A problem which occurs in combustion engines, particularly very large engines manufactured in comparatively small numbers, is that the configuration of the engine is often greatly dependent on the purpose of use. For instance, the demands placed on a stationary engine, such as a power source in a power plant, differ from the demands placed on engines used for the propulsion of ships. In particular, the placing of auxiliary equipment can differ greatly.

In the case of large turbodiesel engines used to drive a stationary generator in a so-called DPP (Diesel Power Plant), it is usually required that the supercharging unit, which is formed by one or more turbo-compressors and associated interstage coolers, be situated close to the edge of the generator space, since the exhaust is placed there. At the same time, it is desired that the flywheel side of the engine (from which the power can be taken off) be located toward the middle of the space where the generator is arranged. However, when a similar engine is used for channel propulsion, it is desirable to direct both the supercharging unit and the flywheel side of the engine to the rear, since both the exhaust and the propeller shaft are situated at the rear of the ship. The pump group, which is used to circulate operating fluids, such as coolant and lubricants, through a stationary engine, must often be placed in the vicinity of the outside of a generator space, since an external cooling unit will often be situated outside the generator space. However, for propulsion purposes, the pump group must be readily accessible in the front part of the engine.

These differing requirements and configurations of the engine mean that an engine suitable for stationary use can be converted into an engine for propulsion purposes only with very great effort and a wide diversity of components. This further implies that the ultimate purpose of use must already be known at an early stage in the construction of the engine, thus considerably increasing delivery times. The production costs of such engines are greatly increased by the large number of different components.

In DE-A-4018620 a turbo-diesel engine is described having its cylinders arranged in V-formation, with two air conduits arranged over each other and extending in the V-shaped space between the cylinder rows. At opposite end faces of the engine block, two identical connecting surfaces are arranged for mounting a turbo-compressor console and an intercooler console, respectively. Various openings are arranged in the connecting surfaces, and those opening which are not used are covered by a plug. This arrangement allows the position of the turbo-charger and the intercooler to be interchanged. This document does not contain any indication about the way the turbo-charger and intercooler may be connected to the coolant and/or lubricant circuit of the engine.

From CH-A-373222, an in-line diesel engine is known having a symmetrical engine block comprising symmetrical connecting surfaces for connecting auxiliary devices at opposite longitudinal faces and end faces of the engine block. In this way, a rotation direction of the engine may be changed by placing the auxiliary devices at either one of the opposite faces. This document does not disclose the use of identical connecting surfaces for different auxiliary devices, nor does it contain any indication of the way in which the auxiliary devices are connected to the coolant and/or lubricant circuit of the engine.

Finally, in DE-C-503438, a combustion engine is described in which all auxiliary devices are arranged in frames at the end faces of the engine. A rotation direction of the engine may be changed by moving part of these auxiliary devices from one side of their respective frame to the other side thereof. This document does not contain any indication of how the auxiliary devices should be connected to the coolant and/or lubricant circuit of the engine either.

SUMMARY OF THE INVENTION

The invention therefore has for its object to provide an engine of the above-described type which can be manufactured more simply and at lower cost. This is achieved according to the invention in that the engine block comprises conduits forming parts of a coolant circuit and a lubricant circuit, each said conduit being connected to all of said connecting parts in such a manner that said auxiliary device may be incorporated into said lubricant and/or coolant circuit independently of the chosen connecting part. By arranging connecting parts at different positions on the engine block, the required auxiliary equipment can be mounted in a simple manner on the engine, at a desired position, and at a very late stage in the construction of the engine. As a result, the manufacturing process can be rationalized considerably and it is possible to easily convert an engine during its lifetime for another use. Furthermore, the auxiliary device can be incorporated in a simple manner in a circuit of operating liquids through the engine, for instance the coolant circuit or lubricant circuit, wherein use can be made of the same conduits, despite different placings of the auxiliary equipment.

Each connecting part preferably has at least two sets of connecting points and the engine is provided with at least two different auxiliary devices. Each auxiliary device co-acts with one of the sets of connecting points.

In a preferred embodiment, any number of the connecting points are closable and means are arranged in the conduits for controlling the flow direction of the operating liquids therethrough.

Because the conduits are arranged in the engine block and the auxiliary equipment, the outside of the engine remains readily accessible for servicing and inspection operations. It is a recommended installation technique that any number of the conduits and connecting points be integrated in a single casting, greatly reducing the number of connecting operations.

For reasons of accessibility, the casting preferably forms a cover fixed to the engine block. The cover can include a front surface and a rear surface located opposite and placed against the engine block. The rear surface can have openings for connecting to the conduits in the engine, wherein the openings are mutually joined by channels recessed in the cover. A compact combustion engine is obtained when the cover is mounted on one outer end of the engine block, and the channels run substantially in the shape of a saddle and enclose a crankshaft bearing arranged in the engine block.

In order to obtain an easily servicable engine, the cover can be a pump cover with at least the front surface having openings for connecting to external conduits and/or pumps. The openings are connected to each other and/or the openings in the rear surface by channels recessed into the cover. When any number of the openings in the rear surface and/or front surface of the cover are closable, and when a valve is arranged in at least one of the channels for controlling the flow direction of the operating fluids therethrough, the cover can be made suitable with comparatively few modifications for use in different configurations of the combustion engine.

The cover preferably has at least one dividing wall arranged between the front surface and the rear surface and substantially parallel thereto. The channels can thus be arranged in the cover in layers separated by the wall, whereby the structure of the cover is greatly simplified.

When the cylinders are disposed in a V-formation, the connecting parts can be situated on the outer ends of the engine block. When the cylinders are disposed in-line, any number of the connecting parts are preferably situated on the side of the engine block.

Auxiliary equipment can include at least one supercharging unit and at least one lubricant unit.

The flexibility of the engine is herein increased when the supercharging unit comprises a seat positioning adjacent one of the connecting parts and supporting at least one turbo-compressor, wherein the seat has arranged channels connecting the turbo-compressor to the conduits in the engine block. Different types of turbo-compressors can thus be used for supercharging of the engine without large modifications of the engine block purpose. A recommended production technique it is to embody the seat as a single casting and to recess the channels therein. The seat can further comprise at least one heat exchanger connected to a cooling system of the engine and preferably forming a module arranged releasably in the casting.

The lubricant unit preferably comprises at least one heat exchanger connected to a cooling system of the engine and at least one filter element placed in series therewith. For optimum control of the temperature of the lubricant, the lubricant unit is preferably further provided with a bypass line running along the heat exchanger and closable by a controllable valve. In order to prevent blockage of the lubricant unit, this latter preferably includes a plurality of independently switchable filter elements placed in parallel. The filtering capacity can thus be adapted to the degree of contamination of the lubricants, while a filter element can be replaced during operation of the engine. In order to simplify the construction of the lubricant unit, the lubrication unit is preferably provided with at least two substantially identical mounting parts co-acting with the connecting parts. The lubricant unit can thus be mounted on the engine block in different ways, wherein the flow direction through the lubricant unit can always be the same.

An exhaust gas conduit system for connecting to the supercharging unit can further be arranged as auxiliary equipment, wherein the connecting parts intended therefor are arranged symmetrically relative to the cylinders, such that the supercharging unit may be connected to either end. In this manner, the supercharging unit and the lubricant unit can simply change position in the case of a switch-cover from a stationary engine to a propulsion engine, wherein the exhaust gas conduit system is rotated a half-turn. From a symmetry consideration, the engine block can, when it has at an outer end a space for accommodating a camshaft drive, herein have a protruding part corresponding therewith on the opposite outer end.

These and other advantages of the present invention will be clarified in the description of the preferred embodiments taken together with the attached drawings in which like reference numerals represent like elements throughout.

BRIEF DESCRIPTION OF THE DRAWINGS

The invention will now be elucidated on the basis of a number of embodiments, wherein reference is made to the annexed drawing, in which:

FIG. 7 is a perspective view of the released pump cover;

FIG. 11 is a section along the line XI—XI in FIG. 10;

FIG. 12 is a partly sectional top view according to arrow XII—XII in FIG. 9;

DETAILED DESCRIPTION OF THE INVENTION

Figure 1:
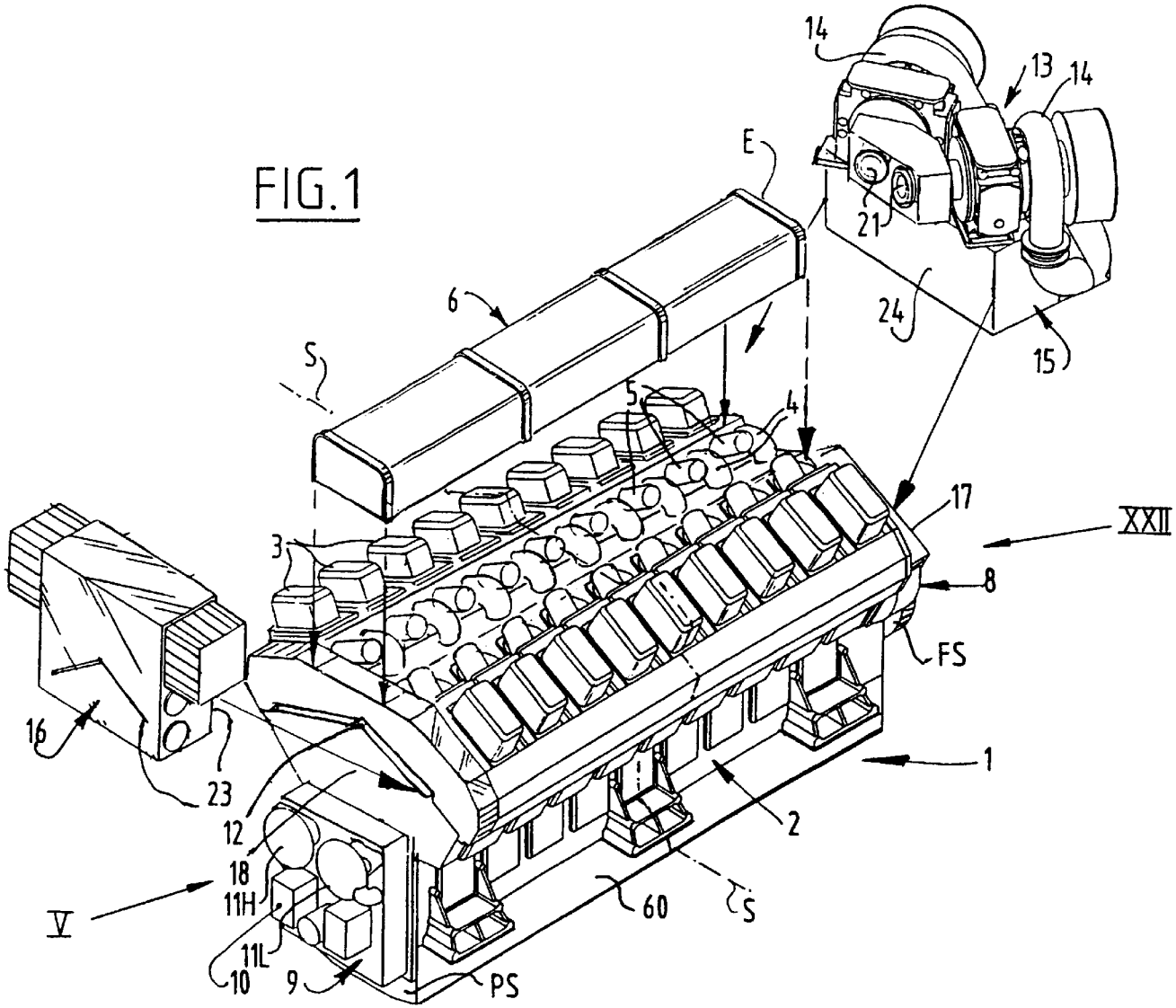
FIG. 1 is a perspective view with exploded parts of a combustion engine according to a first embodiment of the invention for use as propulsion unit.

A combustion engine 1 (FIG. 1) is provided with an engine block 2 having a plurality of cylinders (not shown)

accommodated therein. The cylinders are disposed in a V-formation and are each provided with a cylinder head. The cylinder head is covered by a valve cover 3 and is connected to an intake air conduit 4 and an exhaust gas conduit 5. The outlets all emerge in a collective exhaust gas conduit system arranged in an insulating housing 6. The engine 1 is provided on one end FS with a flywheel 7 arranged on its crankshaft (not shown) and with a housing 8 accommodating a drive mechanism for camshafts operated by the crankshaft. Located on the outer end PS of engine 1, opposite flywheel 7, is a pump cover 9 having an oil pump 10, a low temperature cooling water pump 11L, and a high temperature cooling water pump 1H. Pump cover 9 is herein arranged partially under an overhanging portion 12 of engine block 2, wherein the overhanging portion 12 has dimensions corresponding with those of housing 8. Thus, engine block 2 is practically symmetrical in relation to a line S, making it possible to place the insulating housing 6 thereon in two different positions.

The engine 1 is further provided with a supercharging unit 13 consisting of two turbo-compressors 14 and a so-called seat 15 connected to the turbo-compressors. Arranged in the seat 15, inter alia, is a heat exchanger or interstage cooler. On the opposite side PS, the engine is a lubricant unit 16 accommodating one or more cooling and filter circuits and thermostats. Engine block 2 has on its outer ends FS, PS two substantially identical connecting parts 17, 18 on which the supercharging unit 13 and the lubricant unit 16 can be arranged. For this purpose, the seat 15 of the supercharging unit 13 has a corresponding connecting surface 24, while lubricant unit 16 has two substantially mirror-symmetrical connecting surfaces 23. The exhaust housing 6 is located with its outflow end E to the supercharging unit 13 and the outer ends 22 (FIG. 2) of the double exhaust gas conduit system connected to the connections 21 of the turbo-compressors 14. The exhaust housing 6 is arranged on identical connecting parts on the exhaust gas conduit system which is arranged symmetrically in relation to line S. The shown embodiment of engine 1 is suitable for building into a ship as a propulsion unit because the supercharging unit 13 is placed on the flywheel side FS of engine 1 and the lubricant unit 16 on the opposite pump side PS.

Figure 2:
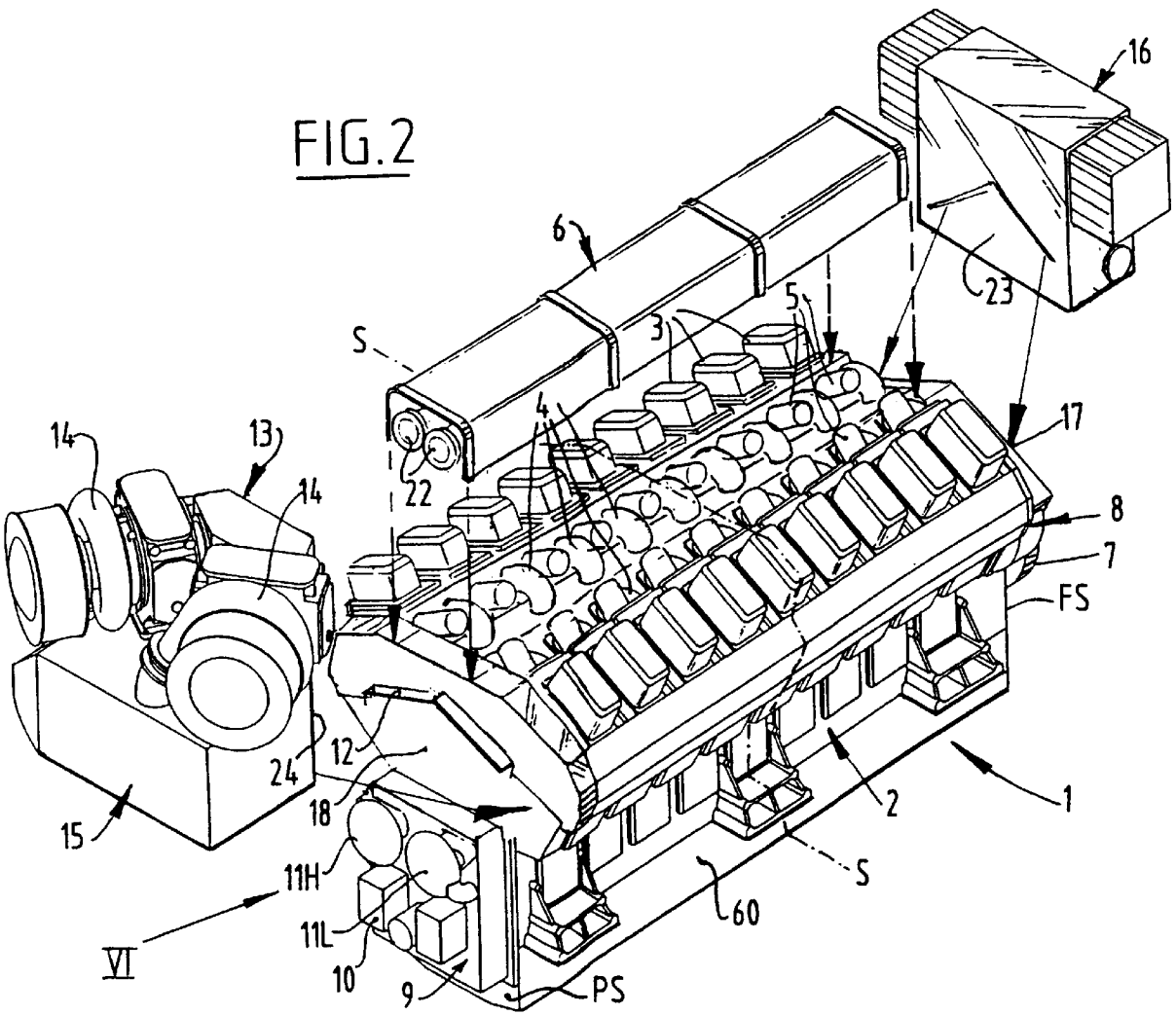
FIG. 2 is a view corresponding with FIG. 1 of a combustion engine intended for stationary use.

When a similar engine 1 must be used as stationary drive, for instance as a generator, it is desired that the supercharging unit 13 be arranged not on the flywheel side FS, but on the pump side PS (FIG. 2). The lubricant unit 16 can then be placed on the flywheel side FS. The supercharging unit 13 is arranged with the connecting surface 24 of its seat 15 against the connecting part 18 of engine 1, while the lubricant unit 16 is placed with its connecting surface 23 against the connecting part 17 on the other side of engine 1. The exhaust housing 6 is rotated a half-turn and fixed once again onto identical connecting parts on the exhaust gas conduit 19, 20, wherein the exhaust gas thus flows to the pump side PS instead of to the flywheel side FS.

As usual, engine 1 has a cooling system and a lubricating system. A plurality of conduits are arranged for this purpose in engine block 2. In order to also include the auxiliary equipment in the cooling and lubricating system, the connecting parts are provided with connecting points for conduits present in the auxiliary equipment. These connecting points are themselves connected to the conduits of the cooling and lubricating system present in the engine. The conduits are arranged as far as is possible in engine block 2 in order to make the installation and assembly of the engine as simple as possible. It is preferred that parts of the conduits and connecting points be integrated in each case into a single casting, whereby installation work is limited still further. In order to make such a casting suitable for use in different configurations of the engine with different auxiliary equipment placed at different locations, any number of the connecting points can be closed, and the conduits further provided with means for controlling the flow directions therethrough. This can be seen in FIGS. 3 and 4, where the paths of the coolant and lubricant flows are shown respectively for the engines of FIG. 1 (propulsion) and FIG. 2 (stationary disposition).

In the propulsion engine (FIG. 3), oil is carried by the oil pump 10 forming part of the pump cover 9 via a conduit 25 to a connecting point 26 of lubricant unit 16. In lubricant unit 16, a part of the oil is guided by means of a thermostat-controlled tap 27 via a circuit 28 through a heat exchanger 37 and cooled. The remainder of the oil runs with the cooled oil from the circuit 28 through a filter 29 and then leaves lubricant unit 16 at the position of a connection 30. The oil then flows through a conduit 62 arranged outside pump cover 9 to a connection 31. The oil then reaches a connection 51 through a conduit 50 (integrated into pump cover 9) and through a knee bend connected thereto. The filtered and cooled oil is guided via a conduit 56 running through a channel 60 into engine block 2 to lubricate the different moving parts of the engine. The oil is eventually collected in channel 60 and once again carried up therefrom by oil pump 10.

Figure 16:
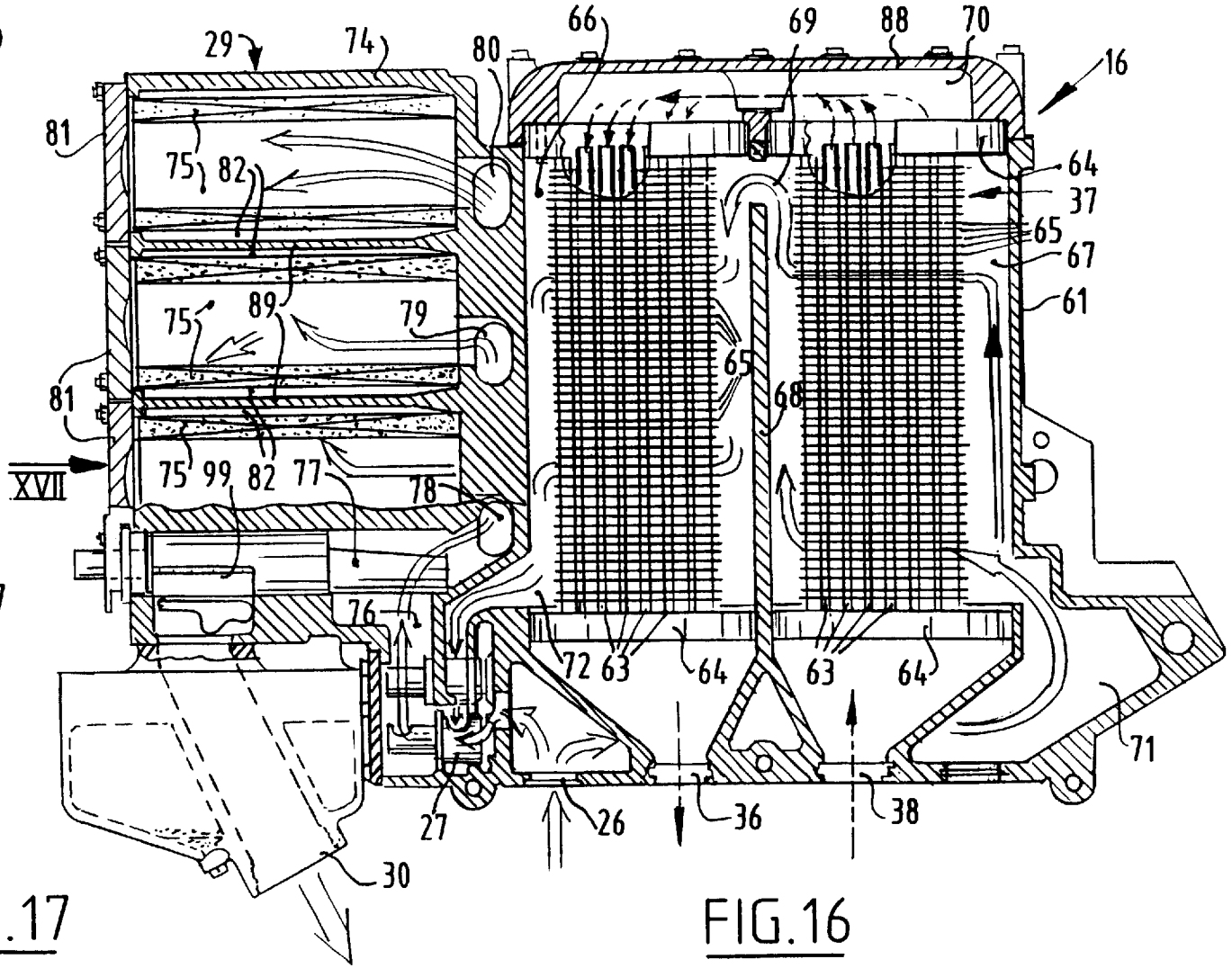
FIG. 16 shows a section through the lubricant unit taken along the line XVI—XVI in FIG. 5.

The flow of the oil through lubricant unit 16 is shown in more detail in FIG. 16. Lubricant unit 16 consists of a housing 61 in which is arranged heat exchanger 37 and filter 29. The heat exchanger 37 includes two pipe packages, each of which is formed by a plurality of parallel tubes 63 which are arranged between end flanges 64 and through which coolant flows. Tubes 63 are further mutually connected by cooling fins 65 which form flow channels for the oil for cooling. The pipe packages 63 are placed in two chambers 77 and 67 of the heat exchanger 37, wherein the chambers are mutually separated by a dividing wall 68 having a through-flow aperture 69. Pipe packages 63 are mutually joined by a connecting channel 70 which is bounded by a cover 88 arranged on housing 61. Through this cover 88, the components of the heat exchanger are easily accessible for servicing or replacement. The oil for filtering and/or cooling flows via connection 26 into the housing 61 of lubricant unit 16. The position of the adjustable valve, such as a thermostat-controlled tap 27, determines which part of the oil flows directly via a passage opening 73 to filter 29 and which part is carried to chamber 67 via a channel 71 running around the inlet and outlet openings 26, 38 of heat exchanger 37. The oil in chamber 67 flows between the cooling fins 65 along the pipe package 63 and is cooled by the coolant flowing through tubes 63. The oil subsequently flows through aperture 69 in dividing wall 68 to chamber 66 where the oil once again flows along pipe package 63 and is thus cooled still further. The oil then leaves heat exchanger 37 via opening 72 and flows along the thermostat-controlled tap 27 to filter 29.

Figure 17:
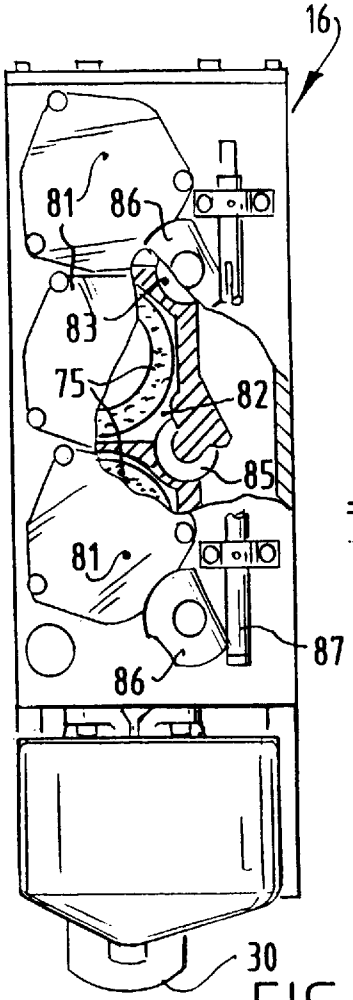
FIG. 17 shows a partly cut away side view of the lubricant unit according to arrow XVII in FIG. 16.

Filter 29 likewise includes a housing 74 having a plurality of receiving spaces 82 mutually separated by walls 89. An annular filter element 75 is arranged in each of the receiving spaces 82, each closed by an associated cover 81. The oil for filtering flows from tap 27 via a space 76, which is closable by means of a closing element 77, to a channel which runs along filter elements 75 and which is connected to filter elements 75 via respective branch lines 78, 79, 80. The oil subsequently flows in a radial direction through filter units 75 into the space between filter units 75 and dividing walls 89. The filtered oil flows therefrom to a collection channel 84 (FIG. 17), from where it flows to the drain aperture 30. The channels 83, 85 which join the filtering spaces 82 to the collection channel 84 are each separately closable. For this purpose, the filter 29 includes three valves 86 (only two of which are shown here) which can each be operated separately by a collective control rod 87. One of the three valves 86 can be closed as desired by displacing control rod 87, whereby the associated filter element 75 no longer forms part of the filtering circuit. For instance, by removing the associated cover 81, the filter element can then be taken out of filter housing 74 and be cleaned or replaced. Valves 86 and control rod 87 are formed such that it is not possible to close all three valves 86 simultaneously. Unintended interruption of the oil circuit through the engine is thus prevented at all times. For the same reason, the closing element 77 is embodied such that, when it occupies a position such that the space 76 to the filter elements 75 is closed, a bypass channel 90 is simultaneously opened which connects the feed space 76 directly to the drain aperture 30.

When the engine is used as a stationary engine in a DPP arrangement, the lubricant unit 16 is situated on the flywheel side FS of the engine (FIG. 4) and the oil must therefore be transported by the oil pump 10 from the pump side PS to the flywheel side FS. For this purpose, the pump 10 is connected to an external conduit 52 which transposes at the position of connection 31 into the part of the conduit 50 (FIG. 3) integrated into pump cover 9. On the underside of pump cover 9, the oil is then transported via a conduit 53, also integrated therein in a transverse direction of the engine block 2 and eventually carried to a connection 47 via an external conduit. The oil is then carried through a conduit 46 running through channel 60 to the flywheel side FS of the engine and from there carried via a transverse conduit 54 and a standing conduit 55 to the connection 26 of lubricant unit 16. Here, the oil runs through the same cooling and filtering circuits as described above. It is noted that the position of the lubricant unit 16 is the same in both cases and, in contrast to the instance the exhaust housing 6 or the supercharging unit 13, the lubrication unit 16 is not rotated through a half-turn when fixed to another connecting part. From the lubricant unit 16, the filtered and cooled oil is guided via a vertical conduit 44, an angle piece 45, and a conduit 56 running through channel 60, wherefrom the oil is guided along the moving parts of the engine itself.

Two separate systems are present for the coolant—a low temperature system and a high temperature system. In the case of the propulsion engine of FIG. 3, the low temperature cooling system is operated by a low temperature cooling water pump 11L which pumps the cooling water via a tap 32 into a conduit 33, transporting the coolant from the pump side PS to the flywheel side FS of the engine block. The coolant then flows through a heat exchanger 34 arranged in the seat 15 of the supercharging unit 13. The heat exchanger 34 forms the second stage of a so-called interstage cooler 96, in which intake air compressed by the turbo-compressors 14 is cooled in two steps from roughly 200° C. to about 50° C. in order to increase the air density and therewith the oxygen content of the intake air. From the heat exchanger 34, the coolant subsequently flows back through a conduit 35 to the pump side PS of the engine where it is guided via a conduit 57 integrated into pump cover 9 and a short, external kneebend to a connection 36 of the lubricant unit 16. In lubricant unit 16, the coolant runs through heat exchanger 37, wherein the oil is cooled in circuit 28. The coolant then flows via connecting point 38 and a conduit partly integrated into pump cover 9, back to the tap 32, and subsequently along a plurality of thermostat-controlled taps 39 via a return conduit 40 to the low temperature coolant pump 11L. These thermostat-controlled taps 39 determine which part of the coolant is suitable for immediate further use and which part must be further cooled in an external cooling unit.

In the case of the engine intended for stationary use (FIG. 4), the low temperature coolant is guided via pump 11L to tap 32, which now occupies a different position. This liquid is then guided through a standing conduit integrated into pump cover 9 to the heat exchanger 34 of the supercharging unit 13 and carried via a partly external conduit 41 and a conduit 57 integrated into a pump cover to the conduit 35, through which the liquid is carried to the flywheel side FS of the engine. The part of conduit 35 inclining in an upward direction connects onto the connecting point 36 of lubricant unit 16, and the coolant once again runs through circuit 37 and leaves the unit at 38. The coolant is subsequently carried back, through conduit 33 to the pump side PS of the engine and then transported via tap 32 and thermostat-controlled taps 39 to the return conduit 40 which is likewise integrated into pump cover 9. In this situation, the flow direction in conduits 33, 35 is thus opposed to that in the case of the propulsion engine.

Figure 3:
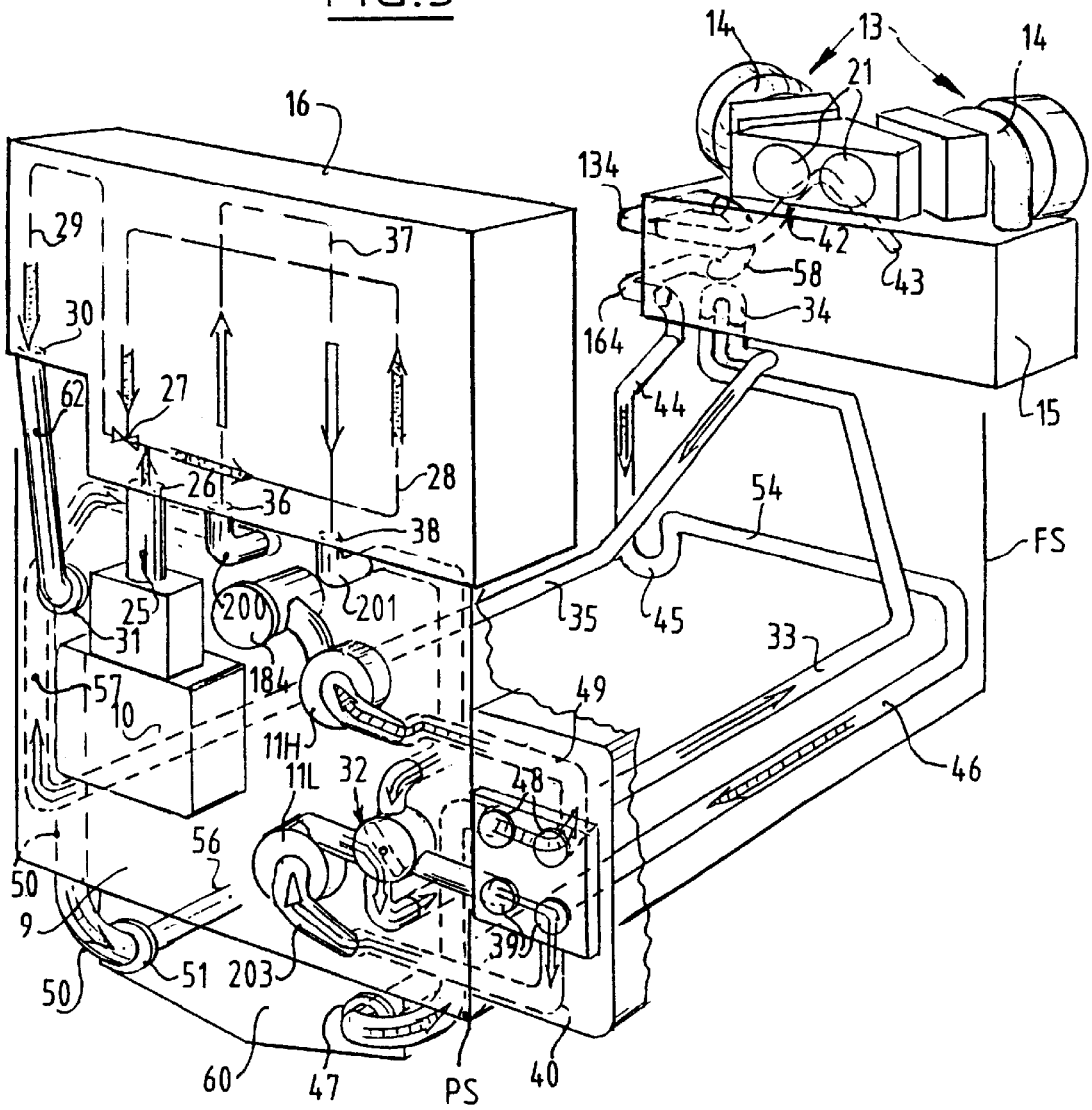
FIG. 3 is a schematic perspective view showing the path of the operating fluid flows in the engine of FIG. 1.

The high temperature cooling system is operated by the high temperature cooling water pump 11H. Coolant is pumped via a connection 184 into the actual engine cooling (FIG. 3). After passing through the engine, the high temperature coolant is collected in connecting points 42, 43 of the supercharging unit 13 and is guided through a heat exchanger 58. This heat exchanger 58 is the first stage of the interstage cooler 96 where the compressed intake air is cooled from about 200° C. to roughly 100° C. High temperature coolant runs from heat exchanger 58 via conduit 44 and a U-tube 45 to the transverse conduit 54 and subsequently through conduit 46 to the connection 47, from where at least a part of the coolant is returned via a plurality of thermostat-controlled taps 48 to the pump 11H via the conduit 49 integrated into the pump cover 9. The conduit 46 and connection 47 used herein are, as discussed above, used as the oil conduit in the stationary embodiment of the engine.

In the stationary embodiment of the engine (FIG. 4), the high temperature cooling water is pumped through the engine by pump 11H and connection 41 and eventually arrives on the pump side in connections 42, 43 of the supercharging unit 13. The coolant then flows once again via the heat exchanger 58 and eventually via an external conduit 59 to the thermostat-controlled taps 48, with a part of the coolant guided back therefrom to pump 11H.

Figure 18:
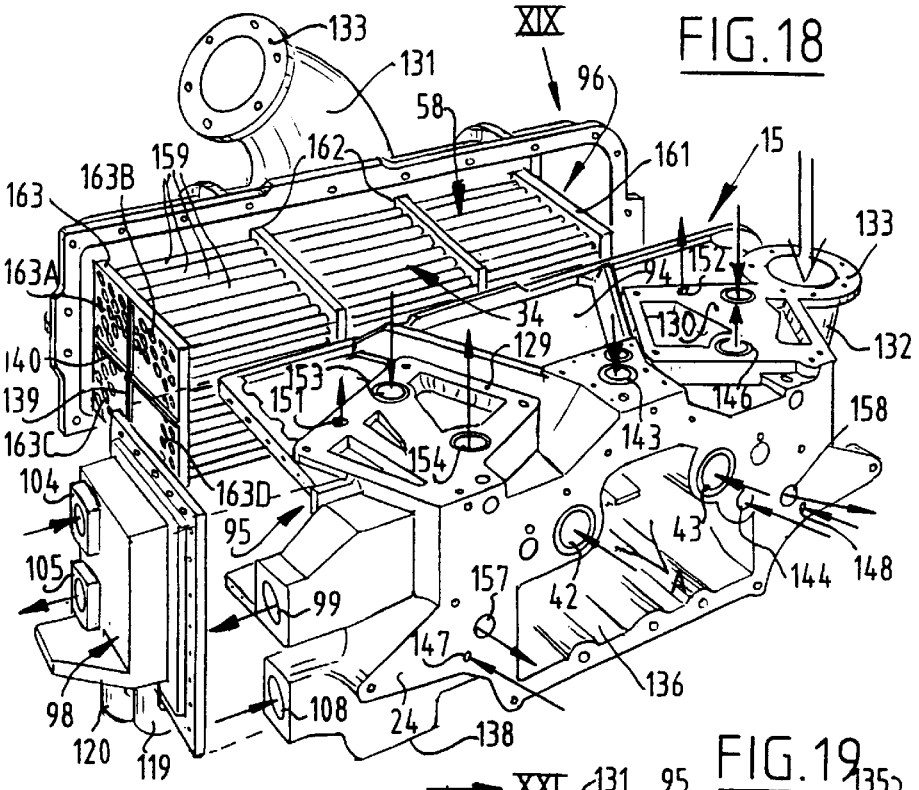
FIG. 18 is a perspective view with exploded parts of the supercharging unit.
Figure 19:
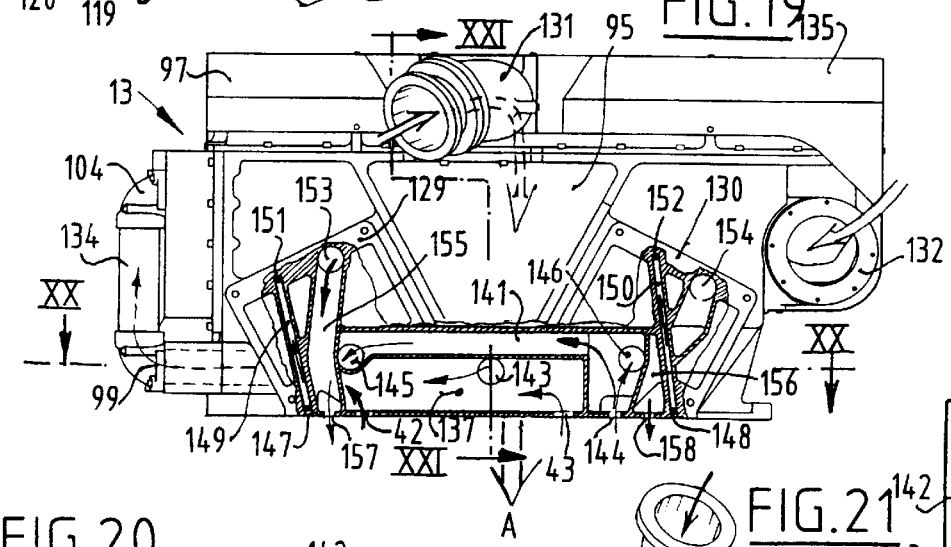
FIG. 19 shows a partly cut away top view of the supercharging unit according to XIX in FIG. 18.

As stated, the supercharging unit 13 comprises a seat 15 which can be mounted on one of the connecting parts 17, 18 and on which the turbo-compressors 14 are arranged. Seat 15 is embodied as a single casting 94 and has channels arranged therein which can be connected to the conduits in the engine block 2 in order to incorporate the turbo-compressors 14 in the cooling and lubricating system of the engine. Further, arranged in seat 15 is a two-stage interstage cooler 96 (FIG. 18) which is joined to the cooling system of engine 1. The interstage cooler 96 is embodied as a module which is accommodated releasably in the casting 94. The latter includes a U-shaped recess 95 which is closed at the rear by a cover 97 and on the side by a cover 98. As stated, the interstage cooler 96 comprises a first stage in the form of the heat exchanger 58 connected to the high temperature cooling system of engine 1 and a second stage formed by heat exchanger 34 which is connected to the low temperature cooling system of engine 1. The comprised intake air, which flows from the turbo-compressors 14 via suction pipes 131, 132 and a channel 135 formed in cover 97 (FIG. 19) to the interstage cooler 96, is cooled therein in two steps from about 200° C. to roughly 50° C. The cooled, compressed air is thereafter blown through a channel 136 into an intake air collection space 91 in engine block 2.

Figure 20:
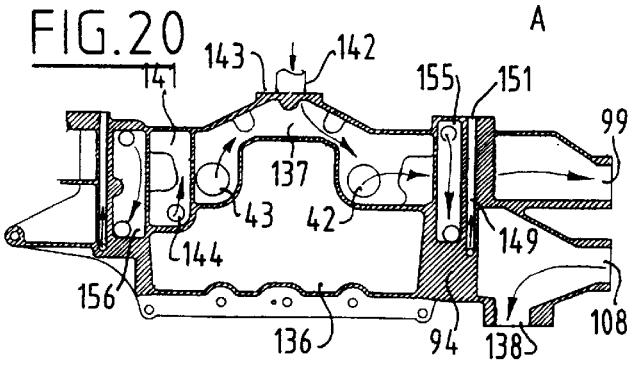
FIG. 20 shows a section along the line XX—XX in FIG. 19.
Figure 21:
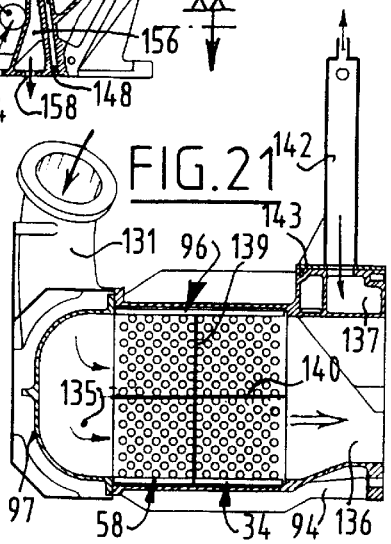
FIG. 21 shows a section along the line XXI—XXI in FIG. 19.

The heat exchangers 34, 58 are each formed by a plurality of parallel tubes 159 which are arranged between perforated end flanges 161, 163 and optionally supported by intermediate flanges 162. The end flange 163 is divided by means of two ribs 139, 140 into four connecting quadrants 163A, 163B, 163C, and 163D. The inside of cover 98 is divided in similar manner into four quadrants and can be connected in a liquid-tight manner to the end flange 163. Connecting quadrant 163A is connected to an opening 104 in cover 98 which is further connected via an external conduit 134 to an opening 99 in casting 94. The opening 99 forms the outlet opening of a channel 137 (FIG. 19) which is arranged in casting 94 and which is provided with three feed openings 42, 43, 143. The high temperature cooling water coming out of the openings 92, 93 (FIG. 6) in the engine block 2 flows through openings 42, 43 into the channel 137, while opening 143 is connected to a return conduit 142 for coolant coming from the turbo-compressors 14 (FIG. 21). The coolant at high temperature thus flows out of channel 137 via conduit 134 to the connecting quadrant 163A and therefrom through the upper part of heat exchanger 58. At the position of the end flange 161, the conduits 159 are mutually connected such that a plurality of return conduits is formed which emerge in the quadrant 163C. The coolant flows therefrom back to engine block 2 via an opening 105 in the cover 98, an eternal conduit 164 (FIG. 3), an opening 108, and an outlet opening 138 in casting 94 (FIG. 20).

As already stated, the second stage 34 of the inter-stage cooler 96 is connected to the low temperature cooling system of the engine. For this purpose, the cover 98 has two connections 119, 120 which are joined respectively to a feed conduit and a drain conduit for coolant at a low temperature. The coolant at a low temperature flows out of connection 119 via the quadrant 163B into the heat exchanger 34 and eventually leaves the heat exchanger 34 via quadrant 163D and subsequently flows back to engine block 2 via connection 120.

Figure 6:
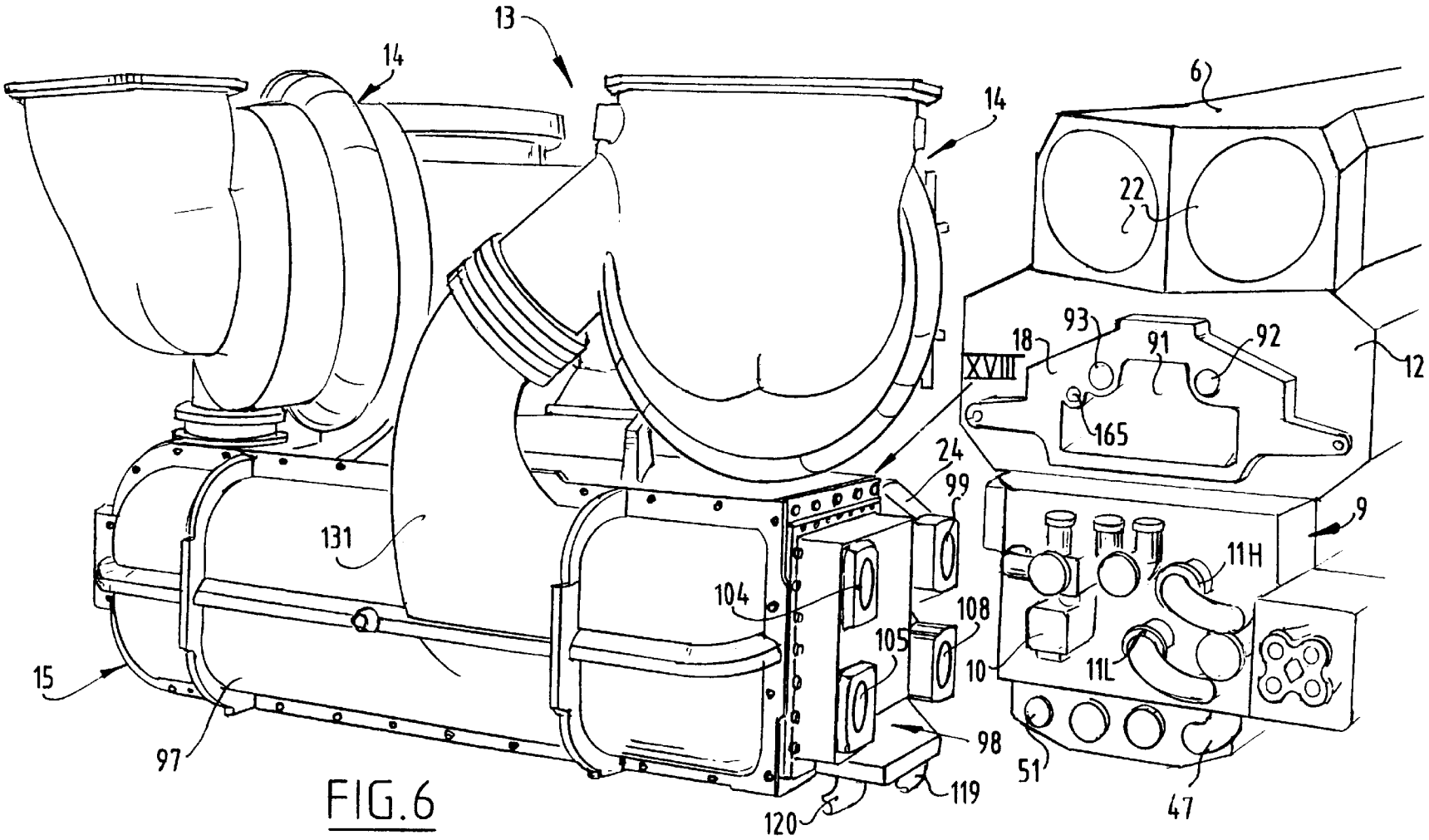
FIG. 6 is a perspective detail view according to arrow VI in FIG. 2.

Further arranged in the casting 94 of seat 15 are channels through which the turbo-compressors 14 can be connected onto the cooling and lubricating system of engine 1. The turbo-compressors 14 are herein mounted on supports 129, 130. Openings 146, 151, 153 (146, 152, 154) are arranged in these supports. The openings are connected via channels in seat 15 to openings 144, 147, 148, 157, 158 in the connecting surface 24 of seat 15. The openings are in turn connected to openings arranged in the connecting part 17 or 18 of the engine 1, whereof only the (comparatively large) cooling water openings 92, 93, 165 are shown here (FIG. 6). Turbo-compressors 14 are connected to the cooling system of engine 1 via a supply aperture 144 for coolant which is connected over a conduit 141 to the openings 145, 146 in supports 129, 130. The coolant flowing through the turbo-compressors 14 is returned to the engine 1 via a return conduit 142 which is connected to seat 15 and emerges in opening 143, out of which the coolant flows into conduit 137. The connection between turbo-compressors 14 and the lubricating system of the engine is formed by the oil supply openings 147, 148 which emerge via respective channels 14, 150 recessed into casting 94 into openings 151, 152 in supports 129, 130. The oil flowing back from turbo-compressors 14 is admitted into casting 94 via openings 153, 154 and subsequently carried via drain conduits 155, 156 to outlet openings 157, 158 in the connecting surface 24.

The pump cover 9 is shown in more detail in FIG. 7. It consists of a single casting with a front surfaces 199 and a rear surface 198 located opposite and placed against engine block 2. Arranged in the front and rear surface 198, 199 are openings which are connected to conduits in engine block 2 and external conduits and pumps. Between the openings are arranged channels recessed into the casting. Further arranged in the casting of pump cover 9 is a plurality of dividing walls 166 which run substantially parallel to the front and rear surfaces and which divide the pump cover 9 into a plurality of layers in which the channels are recessed. Arranged in the front surface 199 of pump cover 9 are three openings 168, 182, 192 in which the pump 11H for high temperature cooling water, and the oil pump 10 can be accommodated. These pumps can be mounted to pump cover 9 by means of mounting flanges 167, 181, 191. The pumps protrude in the pump cover 9 and are driven by a tooth wheel, toothed belt, or chain connected to the crankshaft of engine 1.

Figure 10:
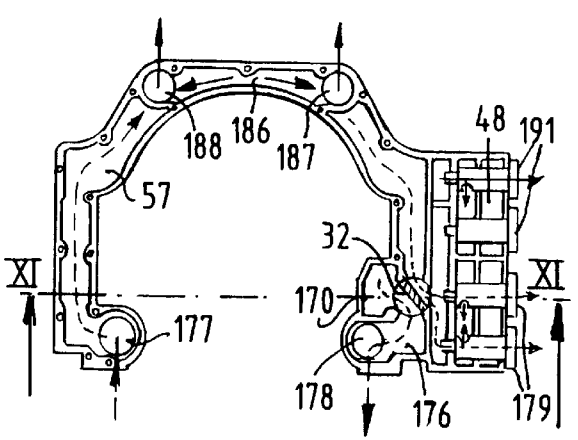
FIG. 10 is a sectional view along the line X—X in FIG. 11.

The low temperature coolant pump 11L serves to circulate the low temperature cooling water through the pump cover 9 and subsequently the engine block 2. In the embodiment of engine 1, shown in FIG. 3, which is intended as a propulsion unit, the low temperature coolant is pumped through an opening 169 in the pump cover and subsequently carried to the valve 32 via a channel 170 running transversely through the cover. Valve 32, which has two positions, serves to control the flow direction of the coolant through pump cover 9 and engine 1. In the position shown in FIG. 10, the low temperature coolant is pumped through conduit 33 (FIG. 3) and into the engine block 2 via an outlet opening 178 in the rear surface 198 of pump cover 9. The coolant flows therefrom through the heat exchanger 34 of the supercharging unit 13 and is subsequently carried back to pump cover 9, where the coolant enters through an opening 177 in the rear surface 198. The low temperature coolant is then guided via the internal conduit 57, which runs along the rear surface 198 via an opening in dividing wall 166 to a channel 175 and therefrom through an outlet opening 174 to a kneebend 200 (FIG. 3) which is connected to the lubricant unit 16. From lubricant unit 16, the coolant is carried back via a kneebend 201 to an intake opening 173 in the front surface 199 of pump cover 9 and subsequently via a conduit 172 through an opening in a dividing wall 166 to a conduit 171. Coolant flow continues to the thermostat-controlled taps 39, via the valve 32. From the thermostat-controlled taps 39 a part of the coolant is carried via outlet openings 179 to an external heat exchanger and the remainder is returned via a conduit 180 running in transverse direction through the pump cover to a connection for an external conduit 203 which leads to the pump 11L.

Figure 9:
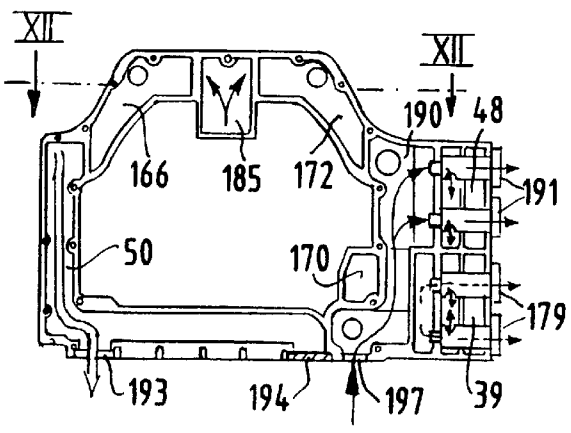
FIG. 9 is a sectional view along the line IX—IX in FIG. 11.
Figure 8:
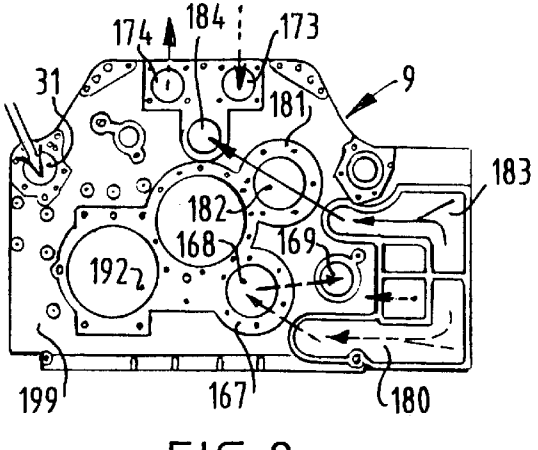
FIG. 8 is a partly sectional front view of the pump cover of an engine intended as propulsion unit as according to arrow VIII in FIG. 7.

The high temperature liquid pump 11L pumps coolant at high temperature via an opening 184 in the front surface 199 of pump cover 9 into a conduit 185 which emerges into a distribution chamber 186, from which the high temperature coolant flows to the engine block 2 via openings 187, 188 in the rear surface 198. The high temperature coolant flowing back out of the engine block 2 arrives from the connection 47 (FIG. 3) via a kneebend in an intake opening 197 in the underside of the pump cover (FIG. 9), from where the coolant flows via channel 190 to the thermostat-controlled taps 48. Here, a part of the high temperature coolant is guide via outlet openings 191 to an external heat exchanger, while the remainder is carried via a collection chamber 183 to an external conduit 204 connected to pump 11H.

The oil pump 10 finally pumps oil, which comes from the lubricant unit 16, via an external conduit to the opening 31 of pump cover 9. Oil flows via conduit 50 to an outlet opening 93 arranged in the underside of the pump cover 9 and an opening 195 likewise arranged in the underside is closed by means of a plug 194. The oil flows out of opening 193 into engine block 2 via a kneebend and a connection 51.

Figure 4:
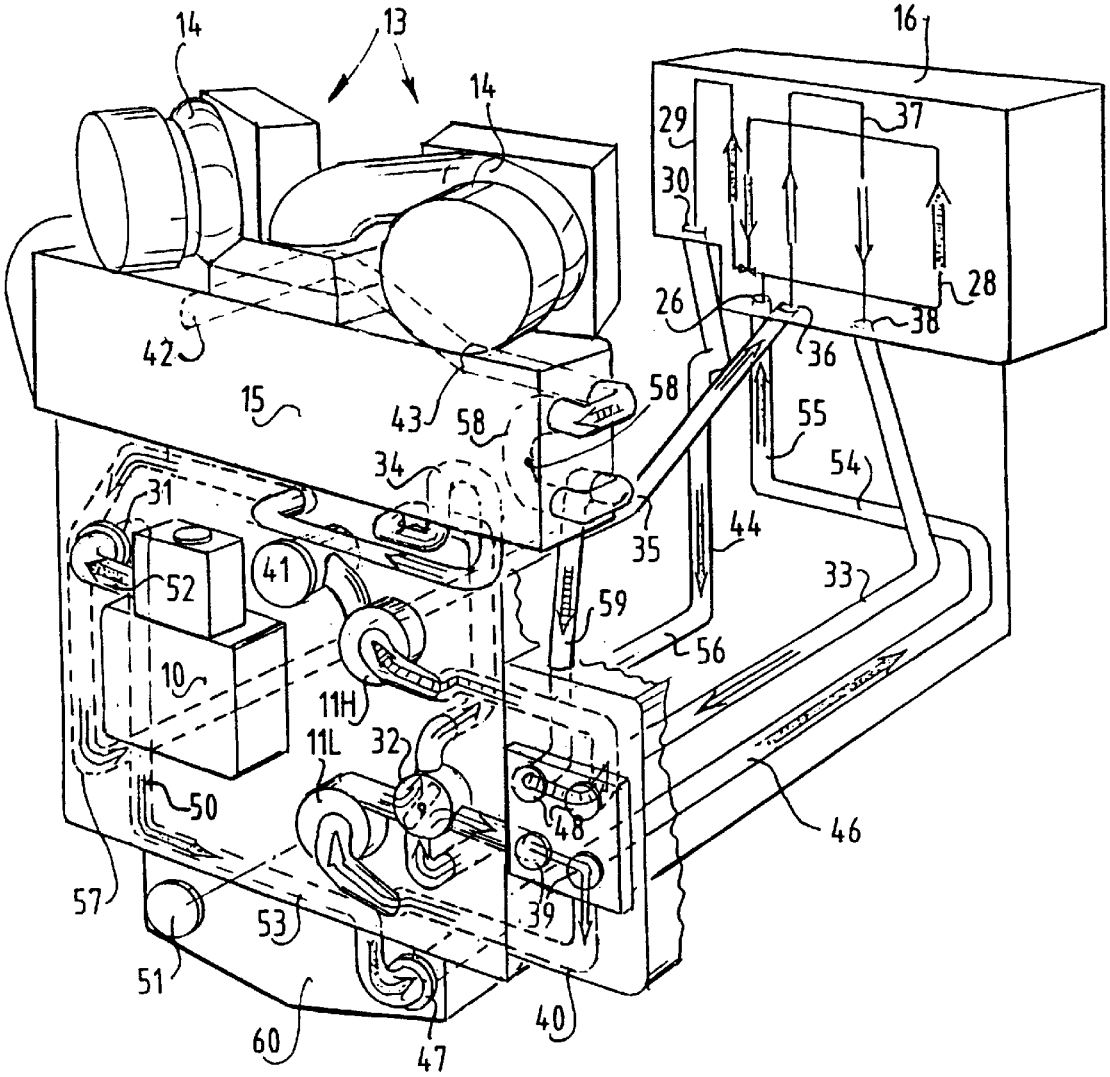
FIG. 4 is a view corresponding with FIG. 3 showing the flows in the engine of FIG. 2.
Figure 5:
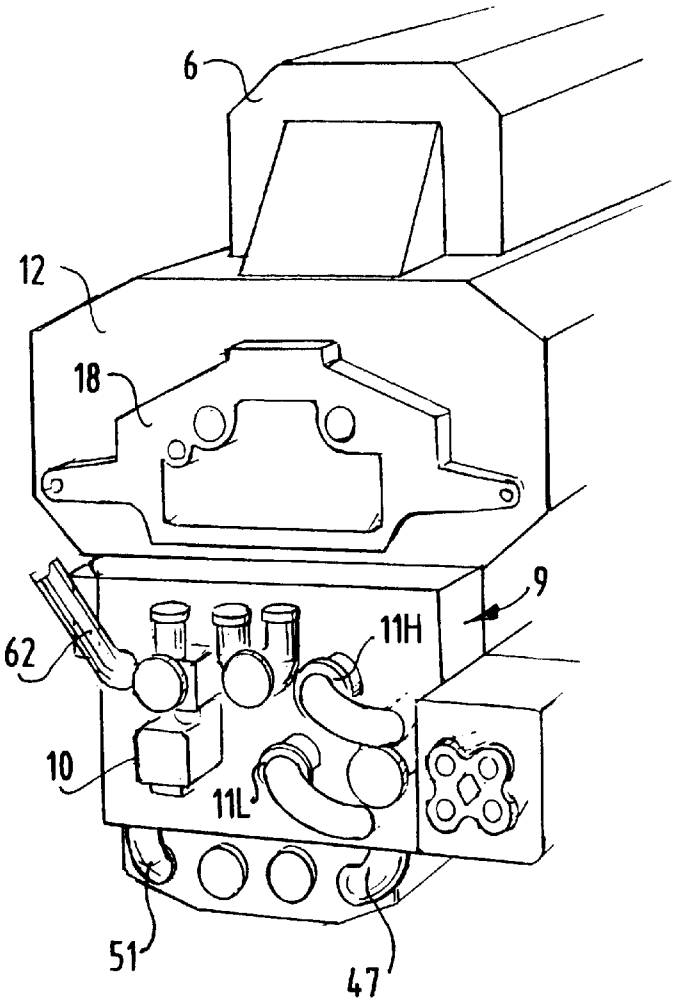
FIG. 5 is a perspective detail view according to arrow V in FIG. 1.
Figure 5:
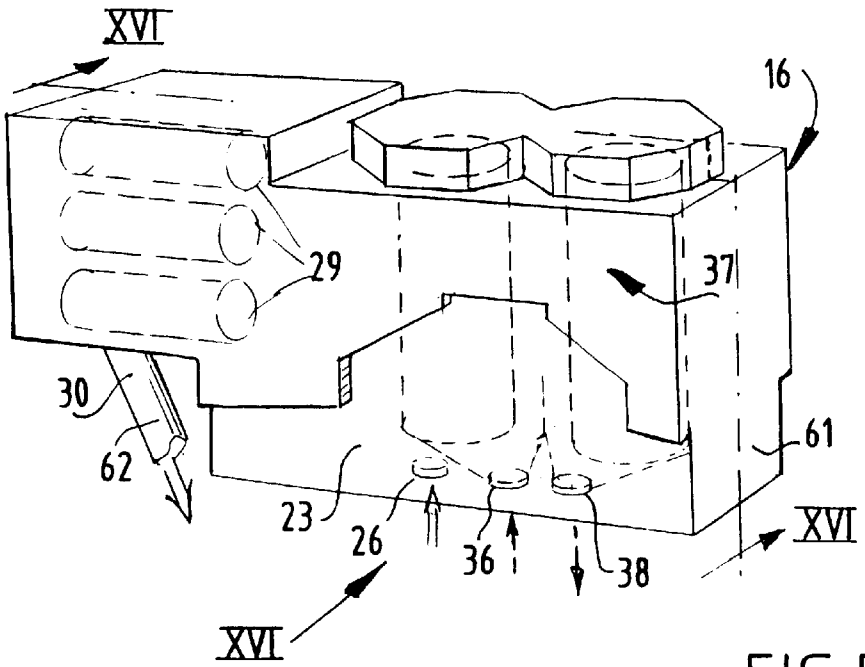
Figure 15:
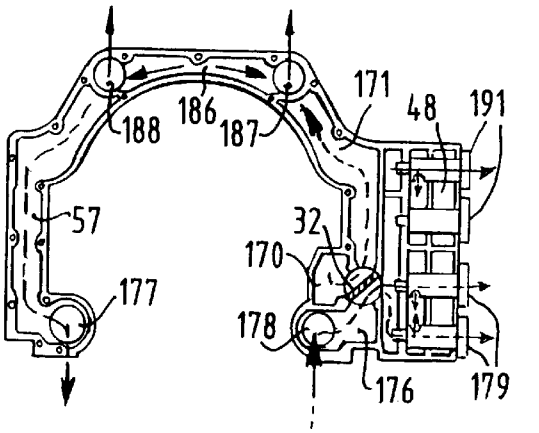
FIGS. 13, 14, and 15 are sections corresponding with FIGS. 8, 9, and 10 of the pump cover of a combustion engine intended for stationary use.
Figure 14:
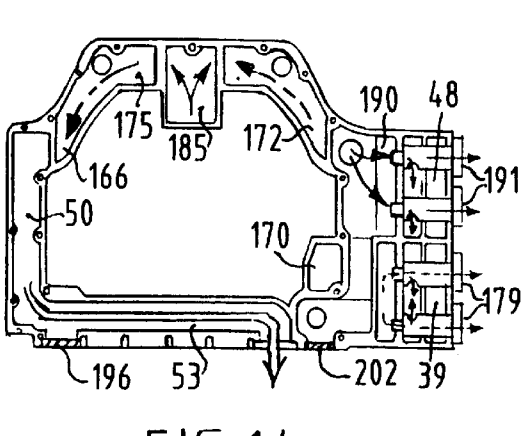
Figure 13:
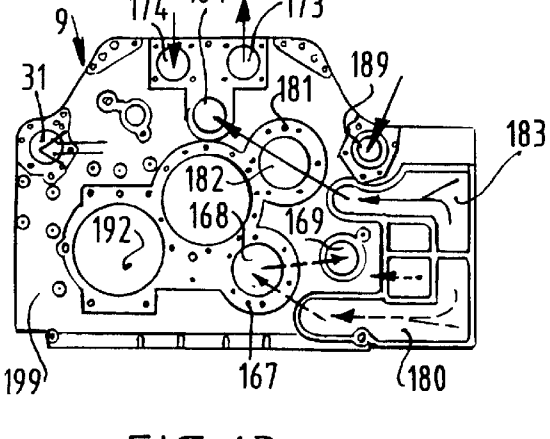

When the engine is intended for stationary use, some of the channels arranged in pump cover 9 are closed and the flow direction is changed by displacing valve 32 (FIGS. 13, 14, and 15). Coolant at low temperature is pumped upward out of pump 11L through channel 171 via opening 169 and conduit 170 and subsequently guided via an opening in dividing wall 166 to channel 172, from where the liquid leaves the pump cover 9 via the opening 173 and is guided to the heat exchanger 34 of the supercharging unit 13. Any low temperature coolant which flows back is eventually guided via opening 174 an channels 175, 57 to the engine again at the rear through an opening 177 to the conduit 35 (FIG. 4). The coolant, which is eventually guided back from lubricant unit 16, is carried via the opening 178 on the rear of the pump cover through the space 176 to the thermostat-controlled taps 39 and then partially back to the pump via the collection conduit 182. The high temperature coolant is admitted into the engine in the same manner as in the case of the pump cover 9 for the propulsion engine, but the coolant at high temperature returning from the engine intended for stationary use is guided via an opening 189 in the front surface 199 (which is plugged in the other variant of the engine) to the space 190 and partially therefrom via the thermostat-controlled taps 48 back again to the collection conduit 183. The opening 197 in the bottom of space 190 is provided in this embodiment with a plug 202. The oil is pumped in this embodiment directly from pump 10 via the connection 31 into the conduit 50. The oil flows therefrom through the horizontal conduit 53 to an outlet opening 195 while outlet opening 193 is closed by means of a plug 196. From outlet opening 195, the oil flows via a kneebend to the connection 47 in the bottom of engine block 2 and therefrom to the lubricant unit 16.

It can thus be clearly seen how, by covering or leaving clear a number of openings and by switching a single valve, the pump cover 9 can be made suitable for use in the engines with very varying coolant and lubricant flows. This results in considerable savings on manufacturing and stock costs. Moreover, as a result of the simple structure of the pump cover with one or more dividing walls and channels arranged in layers, the pump cover can be manufactured at a comparatively low cost.

Figure 22:
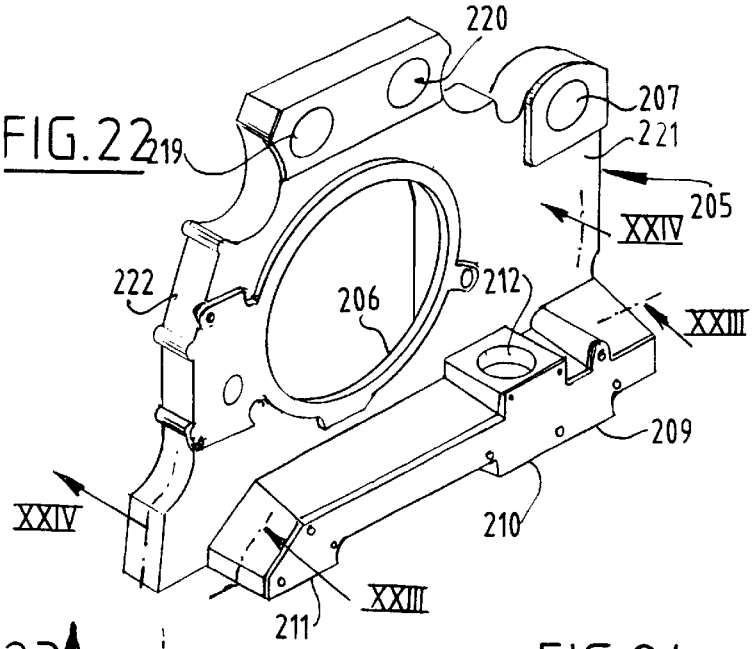
FIG. 22 is a perspective view of a released end cover according to arrow XXII in FIG. 1.
Figure 23:
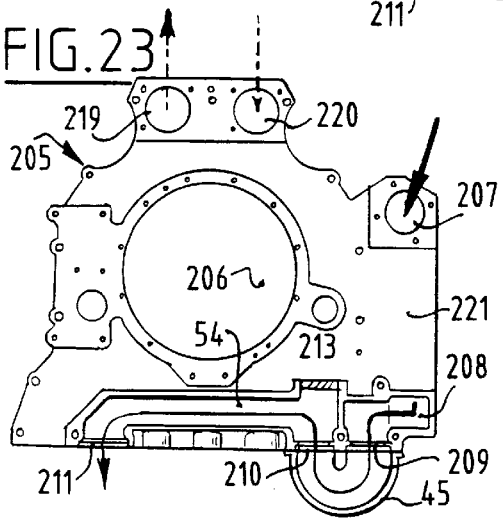
FIG. 23 is a partly sectional front view of the end cover according to arrow XIII in FIG. 22.
Figure 24:
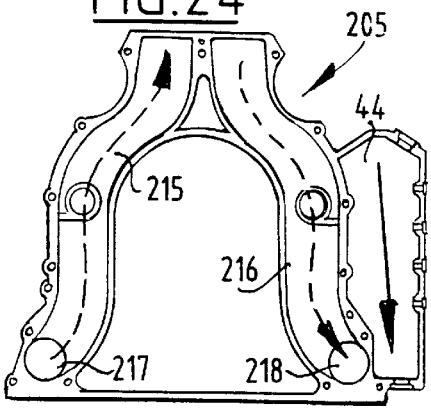
FIG. 24 shows a section along the line XIV—XIV in FIG. 22.
Figure 25:
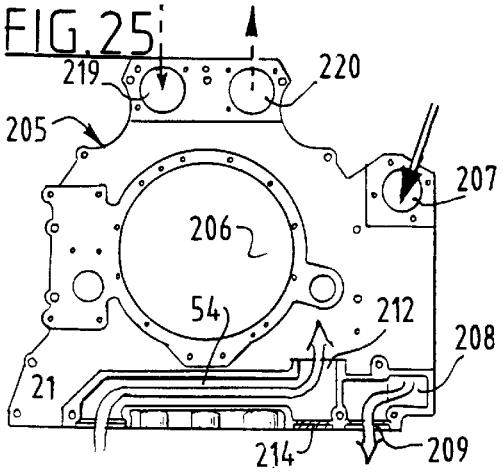
FIGS. 25 and 26 are views corresponding with FIGS. 23 and 24 of the end cover for use in a combustion engine for stationary use.
Figure 26:
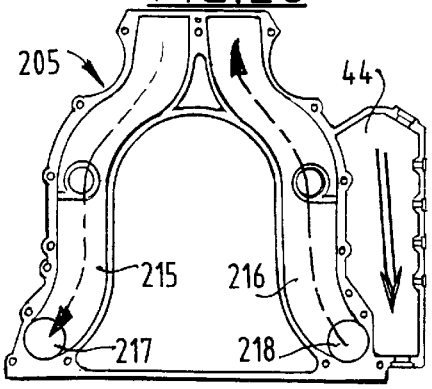

Arranged in similar manner of the flywheel side FS is an end cover 205 which is likewise provided with internal channels which are suitable of different flow directions of the coolants and lubricants. End cover 205 is provided with a central opening 206 through which a power take-off can be connected to the flywheel (FIG. 22). Arranged in cover 205 are substantially saddle-shaped conduits 215, 216 which enclose the crankshaft of the engine. A horizontal channel 54 and a vertical channel 44 are further arranged in the casting. The use of this end cover 205 is as follows. When engine 1 is used as propulsion unit (FIGS. 23 and 24), an opening 212 on the upper side of the horizontal channel 54 is sealed by means of a plug 213. Openings 209, 210 located on the underside of the casting 205 are joined by means of a bend 45. Through this bend 45 flows coolant at high temperature which flows out of the heat exchanger 58 of the supercharging unit 13 via an opening 207 in the end cover 205 and subsequently via channel 44 and a space 208 connected thereto to the bend 45. The high temperature coolant flows therefrom via the channel 54 and an outlet opening 211 to the channel 46 in the bottom of the engine block 2 (FIG. 3). The coolant at low temperature, guided to the heat exchanger 34 of the supercharging unit 13, flows via an opening 217 located on the rear side 222 of the casting 205 facing toward the engine block into the channel 215 and therefrom via an opening 219 located on the front side 221 facing away from the engine block to the connection 119 of the supercharging unit 13. The coolant flowing back from the supercharging unit 13 then flows inside the end cover 205 via the opening 220 on the front side 221 of end cover 205 and flows through channel 216 to an outlet opening 218 on the rear side 222 of the end cover 205. Therefrom, the coolant at low temperature flows back through the conduit 35 (FIG. 3).

When engine 1 is used as a stationary power source, the opening 210 is sealed by means of a plug 214, the bend 45 disappears, and the opening 212 is open. Coolant at low temperature now flows out of conduit 35 in the bottom of the engine block 2 through the opening 218 into conduit 216 and flows upward therefrom to the opening 220, wherefrom the coolant flows through the lubricant unit 16 (FIG. 4). The coolant flowing back out of the lubricant unit 16 again runs via opening 219 through channel 215 and through opening 217 into the engine block to the conduit 33. The channels 44, 54 serve in this application to transport lubricants. In this embodiment, the oil enters the channel 44 through opening 211 and leaves this channel through opening 212, wherefrom it flows into a standing conduit 55 and therefrom to the lubricant unit 16. The filtered and cooled oil from the lubricant unit 16 then flows through opening 207 into channel 44 and flows therefrom via connection 208 and the opening 209 to a conduit 56 running in the bottom of the engine block. It can again be seen how, with a number of small modifications, the end cover 205 can be made suitable for through-flow in different directions, even of different operating fluids. Like pump cover 9, the end cover 205 can also be manufactured in simple manner and at a low cost.

As thus shown, in the case of the propulsion engine of FIG. 3, both the high and low temperature coolants are transported through conduits in the engine block 2 and the channel 60 along the whole length of the engine between the pump side and the flywheel side, while the oil is used only on the pump side and is circulated therefrom further through the engine. Conversely, in the stationary embodiment, the oil and the low temperature cooling water are transported through conduits between both ends of the engine, while the high temperature coolant is used only on one side of the block and in the engine itself. The flow direction through the conduits thus varies with the different applications of the engines.

Figure 27:
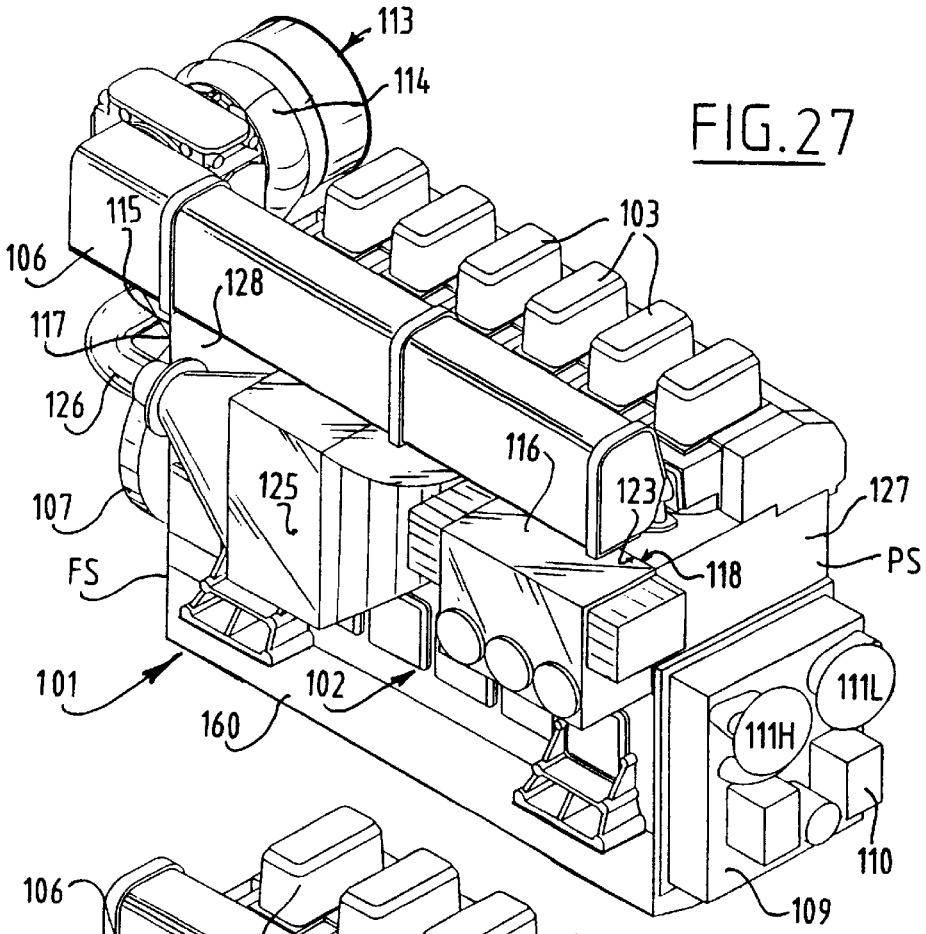
FIG. 27 is a perspective view of a second embodiment of the engine according to the invention for use as propulsion unit.
Figure 28:
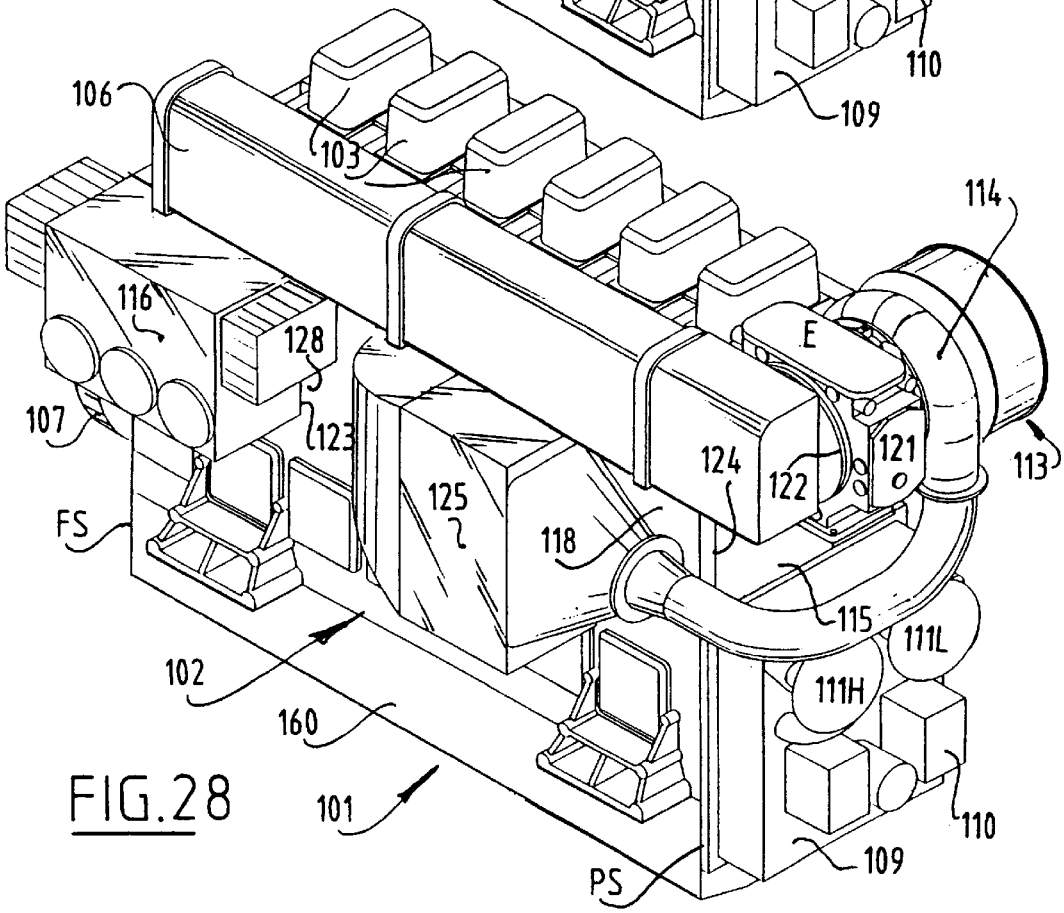
FIG. 28 is a view corresponding with the FIG. 27 of an engine intended for stationary use.

The above embodiments relate to engines with the cylinders in V-formation. When the cylinders are disposed in-line, the auxiliary equipment does not necessarily have to be arranged on the outer ends of the engine block but a side of the engine block can also be used for installation of auxiliary equipment. To this end, an in-line engine 101 according to the invention (FIG. 27) also has, in addition to two connecting parts 117, 127 on the ends of engine block 102, two connecting parts 118, 128 on the side of block 102. In the shown embodiment, the supercharging unit 113 is arranged with its seat 115 on the connecting part 117 on the flywheel side FS of engine 101 while the lubricant unit 116 is arranged on the connecting part 118 on the side of engine block 102 in the vicinity of the pump side PS. The supercharging unit 113 is further connected along a conduit 126 to an air box 125 for the interstage cooler for compressed intake air, which is likewise fixed to the side of engine block 102. When engine 101 is intended for stationary use, the supercharging unit 113, the lubricant unit 16, and the air box 125 again change places, while the latter portion of exhaust housing 106 is rotated a half-turn (FIG. 28).

Although the pump cover and end cover embodied as casting, the supercharging unit with its seat embodied as casting and the lubricant unit are described above in relation to a very specific combustion engine whereof the engine block is suitable for incorporating particular auxiliary equipment at different positions, it will be apparent to the skilled person that, while still retaining the structural advantages associated therewith, these components can also be applied in conventional engines suitable for only a single configuration.

The invention has been described with reference to the preferred embodiment. Obvious modifications and alterations will occur to others upon reading and understanding the preceding detailed description. It is intended that the invention be construed as including all such modifications and alterations insofar as they come within the scope of the appended claims or the equivalents thereof.

What is claimed is:

1. A method for manufacturing a combustion engine comprising the steps of:

manufacturing an engine block;

arranging substantially identical connecting parts at two different positions on the engine block;

arranging conduits in the engine block, the conduits forming part of a coolant circuit and a lubricant circuit, and each conduit being connected to all of the connecting parts;

determining the use of the engine; and connecting an auxiliary device to at least one of the connecting parts in such a manner that said auxiliary device is incorporated into any of the conduits without changing the shape of the engine block, the connecting parts, or the conduits.

2. An engine block having a plurality of cylinders received therein, the engine block having at two different locations substantially identical connecting parts for an auxiliary device wherein the engine block comprises conduits being connected to all of the connecting parts in such a manner that the auxiliary device may be incorporated into any of the conduits without changing the shape of the engine block, the connecting parts, or the conduits.

3. A combustion engine provided with an engine block having a plurality of cylinders received therein and at least one auxiliary device connected to the engine, wherein the engine block has at least at two different locations substantially identical connecting parts and the at least one auxiliary device is arranged on such a connecting part wherein the engine block comprises conduits forming parts of a coolant circuit and a lubricant circuit, each said conduit being connected to all of said connecting parts in such a manner that said auxiliary device may be incorporated into said lubricant and/or coolant circuit independently of the chosen connecting part.

4. The combustion engine as claimed in claim 3, wherein each connecting part has at least two sets of connecting points and the engine is provided with at least two different auxiliary devices, each co-acting with one of the sets of connecting points.

5. The combustion engine as claimed in claim 4, wherein at least a number of the conduits and connecting points are integrated in a single casting.

6. The combustion engine as claimed in claim 5, wherein the casting forms a cover for use with the engine block of the combustion engine and is fixed to the engine block.

7. The combustion engine as claimed in claim 6, wherein the cover comprises a front surface and a rear surface located opposite and placed against the engine block, which rear surface has openings for connecting to the conduits in the engine block, which openings are mutually joined by channels recessed in the cover.

8. The combustion engine as claimed in claim 7, wherein the cover is mounted on one outer end of the engine block and the channels run substantially in the shape of a saddle and enclose a crankshaft bearing arranged in the engine block.

9. The combustion engine as claimed in claim 7, wherein the cover is a pump cover and at least the front surface has openings for connecting to external conduits and/or pumps, which openings are connected by channels recessed into the cover to each other and/or the openings in the rear surface.

10. The combustion engine as claimed in claim 7, wherein at least a number of the openings in the rear surface and/or front surface of the cover are closed by closing means.

11. The combustion engine as claimed in claim 7, wherein a valve is arranged in at least one of the channels for controlling the flow direction of the operating fluids therethrough.

12. The combustion engine as claimed in claim 7, wherein the cover has at least one dividing wall arranged between the front surface and the rear surface and substantially parallel thereto.

13. The combustion engine as claimed in claim 3, wherein at least a number of the connecting points are closable and means are arranged in the conduits for controlling the flow direction of the operating liquids therethrough.

14. The combustion engine as claimed in claim 3, wherein the cylinders are disposed in a V-formation and the connecting parts are situated on the outer ends of the engine block.

15. The combustion engine as claimed in claim 3, wherein the cylinders are disposed in-line, and at least a number of the connecting parts are situated on the side of the engine block.

16. The combustion engine as claimed in claim 3, further including as auxiliary equipment at least one supercharging unit for use with the combustion engine and at least one lubricant unit for use with the combustion engine.

17. The combustion engine as claimed in claim 16, wherein the supercharging unit comprises a seat for fixing to one of the connecting parts and supporting at least one turbo-compressor, in which seat are arranged channels connecting the turbo-compressor to the conduits in the engine block.

18. The combustion engine as claimed in claim 17, wherein the seat is embodied as a single casting and the channels are recessed therein.

19. The combustion engine as claimed in claim 17, wherein the seat comprises at least one heat exchanger connected to a cooling system of the engine.

20. The combustion engine as claimed in claim 19, wherein the heat exchanger forms a module arranged releasably in the casting.

21. The combustion engine as claimed in claim 17, wherein the lubricant unit comprises at least one heat exchanger connected to a cooling system of the engine and at least one filter element placed in series therewith.

22. The combustion engine as claimed in claim 21, further including a bypass line running along the heat exchanger and closable by a controllable valve.

23. The combustion engine as claimed in claim 21, further including a plurality of independently switchable filter elements placed in parallel.

24. The combustion engine as claimed in claim 21, further including at least two substantially identical mounting parts co-acting with the connecting parts of the engine block.

25. The combustion engine as claimed in claim 16, further including as auxiliary equipment an exhaust gases conduit system for use with the combustion engine, and the connecting parts intended for the exhaust gases conduit system, the exhaust gases conduit system and the connecting parts arranged symmetrically relative to the row of cylinders, such that the supercharging unit may be connected to either end.

26. The combustion engine as claimed in claim 25, wherein the engine block has on one outer end a space for accommodating a camshaft drive, and a protruding part corresponding therewith on the opposite outer end.

* * * * *